US005603386A

United States Patent [19]

Webster

[11] Patent Number: 5,603,386

[45] Date of Patent: Feb. 18, 1997

[54] DOWNHOLE TOOL FOR CONTROLLING THE DRILLING COURSE OF A BOREHOLE

[75] Inventor: David W. Webster, Aylburton, Great Britain

[73] Assignee: Ledge 101 Limited, Aberdeen, Scotland

[21] Appl. No.: 524,953

[22] Filed: Sep. 8, 1995

Related U.S. Application Data

[63] Continuation of Ser. No. 140,026, filed as PCT/GB93/00465, Mar. 5, 1993, published as WO93/18273, Sep. 16, 1993, abandoned.

[30] Foreign Application Priority Data

Mar. 5, 1992 [GB] United Kingdom ..... 9204910

[51] Int. Cl.[6] ..... E21B 7/06; E21B 47/08

[52] U.S. Cl. ..... 175/76; 175/45; 175/325.3

[58] Field of Search ..... 175/45, 61, 73, 175/76, 326, 325.3, 325.4

[56] References Cited

U.S. PATENT DOCUMENTS

| | | | |
|---|---|---|---|
| 3,298,449 | 1/1967 | Bachman et al. | 175/76 |
| 3,595,326 | 7/1971 | Claycomb | 175/73 |
| 5,220,963 | 6/1993 | Patton | 175/24 |

FOREIGN PATENT DOCUMENTS

| | | | |
|---|---|---|---|
| 0324870 | 7/1989 | European Pat. Off. . | |
| 2066878 | 7/1981 | United Kingdom | 175/76 |
| 2177738 | 1/1987 | United Kingdom . | |
| 92/14027 | 8/1992 | WIPO . | |

*Primary Examiner*—David J. Bagnell

*Attorney, Agent, or Firm*—Watson Cole Stevens Davis, P.L.L.C.

[57] ABSTRACT

A downhole tool connectable to a drill string by a connection atop the tool includes a mandrel for connection with the drill string, the mandrel being rotatable within a body. A plurality of blades are individually extendible radially from the body to engage the wall of a well bore, the radial position of the blades being adjustable between a first retracted position and a second extended position to position the centre line of the mandrel at a desired position relative to the longitudinal axis of the well bore. A positioning system is provided to hold each of the blades at the retracted position, the extended position or at any intermediate position therebetween.

21 Claims, 4 Drawing Sheets

102
112
104
108
100
114
104
110
106

124
118
120
116
124
122

DOWNHOLE TOOL FOR CONTROLLING THE DRILLING COURSE OF A BOREHOLE

CROSS-REFERENCE TO RELATED APPLICATION

This is a continuation of U.S. patent application Ser. No. 08/140,026, filed Oct. 27, 1993, now abandoned, which derived from PCT/GB93/00465, filed Mar. 5, 1993, published as WO93/18273 Sep. 16, 1993.

BACKGROUND OF THE INVENTION

1. Field of the Invention

This invention relates to a downhole tool which can act as a variable stabiliser or a control for directional drilling.

2. The Prior Art

It is well known to provide apparatus for deflecting a portion of a drill string to impart a curve to the drill string in order to control the direction of drilling, or to control the deviation of the borehole from the initial centreline of the bore. It may be that it is desired to restrain deviation of the borehole from the initial centreline, or to increase the directional deviation. However, such known devices are often unreliable and uneconomic.

U.K. patent publications 2172324, 2172325 and 2177738 disclose a stabiliser comprising: a housing which is adapted to engage with a well bore by means of a wall contact assembly, such that the housing is coaxial with the well bore, a mandrel rotatable within the housing: and hydraulic actuator means for positioning the centreline of the mandrel relative to the longitudinal axis of the housing and of the well bore.

Prior art stabilisers have controllable positioning devices which are movable between a position in which the stabiliser is centred in the borehole and a position in which the stabiliser is offset from the centreline of the borehole. Each positioning device is movable between a first retracted position and a second extended position, but cannot be held at any intermediate position between the fully retracted and fully extended positions. Thus, such known stabilisers only provide relatively crude control for directional drilling and other related activities.

SUMMARY OF THE INVENTION

According to the present invention there is provided a downhole tool adapted to be connected to a drill string, the tool comprising: a mandrel for connection with the drill string; a body, the mandrel being rotatable within the body; and a plurality of blades extendible radially from the body to engage the wall of a well bore, the radial position of the blades being adjustable between a first retracted position and a second extended position, to position the centreline of the mandrel at a desired position relative to the longitudinal axis of the well bore, wherein means are provided for holding each of the blades at the retracted position, at the extended position or at any intermediate position between the retracted and extended positions.

The blades are preferably parallel axially-extending blades disposed about the periphery of the body, and in a particularly preferred embodiment three such blades are equi-angularly disposed about the body.

In a preferred embodiment, the blades are extendible to engage the wall of the well bore, the radial position of the blades then providing a measurement of borehole diameter. A preferred embodiment of the present invention may be used as a stabiliser to provide a positive level of control in the following areas: vertical well control, stabilisation of casing milling and fishing tools, controlled orientation of directional drilling assemblies (thereby replacing the need for steerable motors), and side tracking operations where casing milling tools can be run in a manner similar to that achieved by casing whipstocks. The preferred tool is intended to provide vertical well control and the stabilisation of casing milling and fishing tools by mechanical means only.

The tool of the present invention is able to control the tool face direction and to operate at any deviation in the range of zero offset to maximum offset, due to the means for holding each of the blades at any position between the retracted and extended positions. Thus, the tool can drill a curve having any required profile, including catenary curves which are recognised as being highly desirable, but which up till now have not been possible to drill. Such curves can be drilled either under program control or in response to triggers.

BRIEF DESCRIPTION OF THE DRAWINGS

The invention will now be described in more detail by way of example with reference to the accompanying drawings, in which.

DETAILED DESCRIPTION OF THE PREFERRED EMBODIMENT

Figures 1A, 1B:
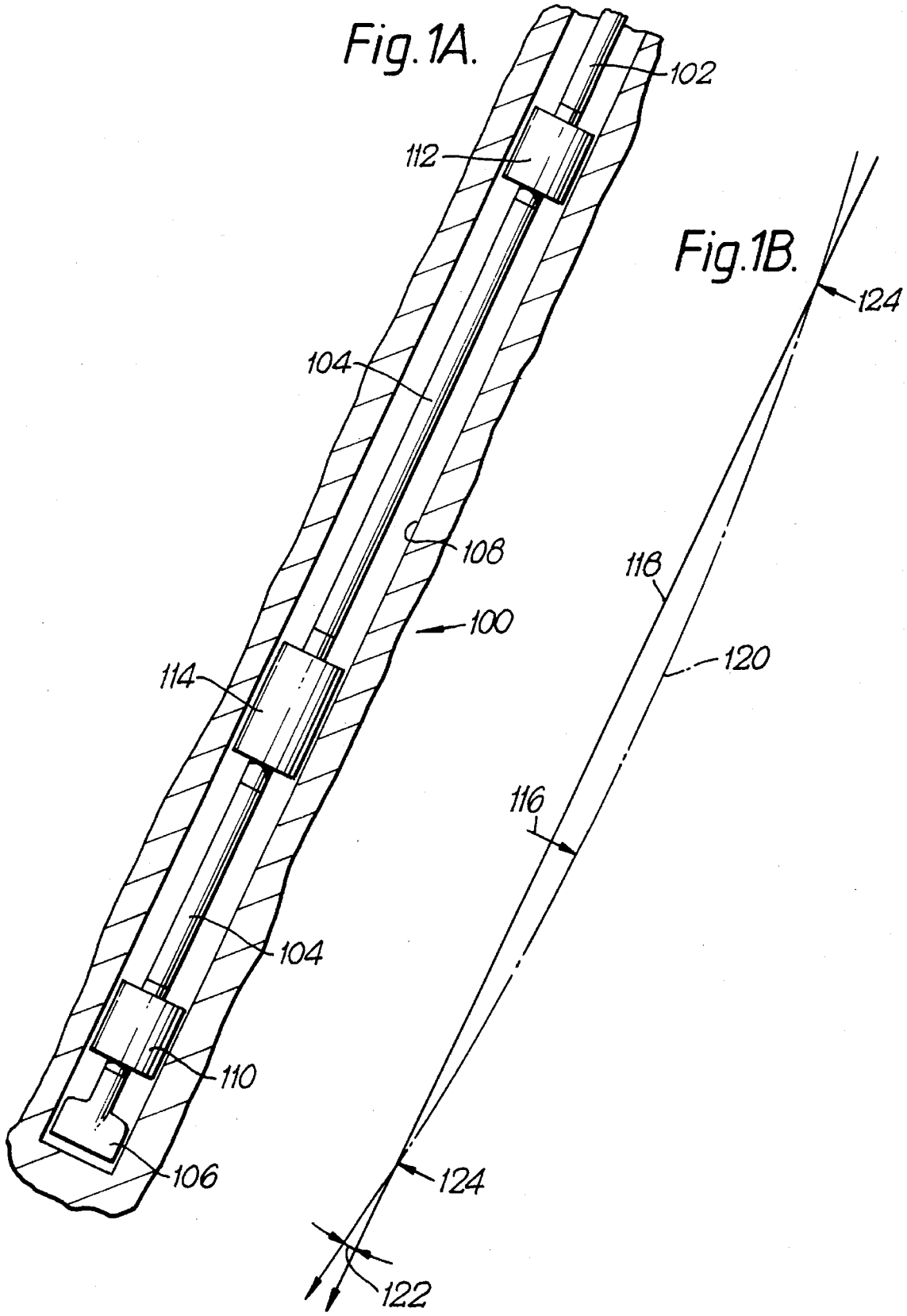
FIG. 1A is a schematic view of the bottom hole assembly including a tool according to the present invention.
FIG. 1B is a diagrammatic representation of the movement of the bottom hole assembly of FIG. 1A produced by the tool.

Referring first to FIG. 1A, which illustrates the general principle underlying directional drilling in accordance with the present invention, the bottom hole assembly (BHA) 100 is connected with a drill string 102 and comprises a rotatable drilling tube 104 carrying a drill bit 106 at its free end. The drilling tube 104 is supported and centered within a bore hole 108 by a near bit stabiliser 110 and a far bit stabiliser 112, both of these stabilisers being of conventional design. Positioned between the near and far bit stabilisers 110 and 112 is a variable stabiliser 114 in accordance with the present invention. The variable stabiliser 114 can be operated to apply a lateral force and displacement (as shown by arrow 116 in FIG. 1B) to the drilling tube 104 in order to deflect the tube from its centreline position between the supports provided by stabilisers 110 and 112. FIG. 1B diagrammatically illustrates the undeflected drilling tube at 118, and the deflected drilling tube 120, the change in drilling direction being indicated by the angle 122. The stabilisers 110 and 112 provide a force indicated by arrows 124 which holds the drilling tube at the centreline of the well bore at the locations of the stablisers 110 and 112, resulting in the deflected shape of the drill tube indicated at line 120.

Figure 2:
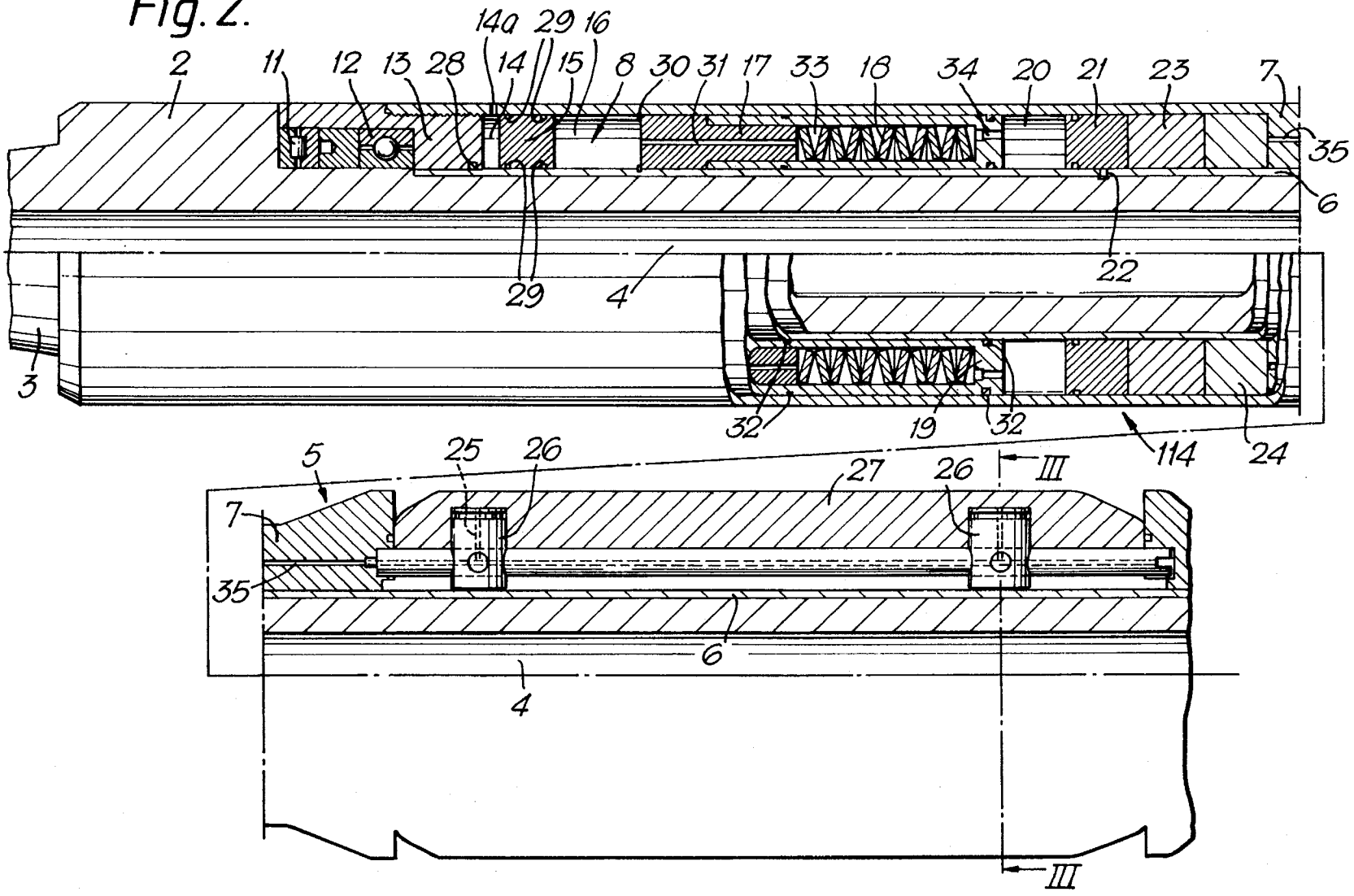
FIG. 2 shows in partial cross-section a longitudinal view of a tool according to the present invention.

FIG. 2 illustrates in more detail the tool of the present invention employed as stabilisers 114 shown in FIG. 1A.

The stabilisers 114 of FIG. 2 comprises a mandrel 2 which rotates relative to the well bore and is used to connect the drive from the upper portion of the drill string and bottom hole assembly (BHA) to the lower part of the BHA. A pin connection 3 is provided for connecting the mandrel to the lower part of the BHA, and there is a through bore 4 which passes through the longitudinal centre of the mandrel 2. The main body of the stabiliser is formed by a body 5 which is substantially non-rotational relative to the well bore during drilling of the bore.

The body 5 incorporates an upper bearing assembly (not shown), a lower thrust bearing assembly 11, a radial bearing assembly 12 and an end cap 13 for retaining the bearings in position such that the mandrel 2 and the body 5 can rotate relative to each other. The body 5 comprises an inner sleeve 6 and an outer sleeve 7 and an annular-chamber 8 is formed between the inner and outer sleeves. A low pressure piston 15 and a high pressure piston 19 divide the chamber 8 into a pressure equalisation chamber 14, a low pressure hydraulic fluid chamber 16 and a high pressure hydraulic fluid chamber 20. The pressure equalisation chamber 14 communicates with the fluid in the well bore by means of openings 14*a* through the outer sleeve 7. Thus, the pressure equalisation chamber 14 will become flooded with drilling fluid which enters through the openings 14*a* when the drilling string commences operation.

A seal 28 is provided between the end cap 13 and the inner sleeve 6 for preventing ingress of drilling fluid to the bearing assemblies 11, 12. A number of further seals 29 are provided on the low pressure piston 15 which prevent contamination of the hydraulic fluid in the low pressure chamber 16 with the drilling fluid.

Between the low pressure piston 15 and the high pressure piston 19, a circlip 30 holds a spring stop 17 in place in chamber 8. A longitudinal passageway 31 is formed in the spring stop 17, such that the low pressure hydraulic fluid communicates from the low pressure chamber 16 to a spring chamber 33 on the other side of the spring stop. A biasing means comprising a stack of Belville washers 18 or a coil spring or any other suitable biasing means is provided in the spring chamber 33 between the spring stop 17 and the high pressure piston 19. The biasing means stores the energy necessary to activate the stabiliser.

A number of seals 32 are provided on the high pressure piston 19 which seal the high pressure chamber 20 from the low pressure spring chamber 33. A passageway 34 through the high pressure piston 19 connects the low pressure chambers 16 and 33 with a pump 21. The pump 21 is in direct communication with the high pressure chamber 20, and is used to transfer hydraulic fluid from the low pressure chambers to the high pressure chamber. The pump 21 may be operated by a piston 22, which is advantageously driven by a cam or an eccentric profile machined into the mandrel, and one-way valves are provided to take the hydraulic fluid from the low to the high pressure chamber. For simplicity of manufacture it may be preferable for the pump 21 to be incorporated in the high pressure piston 19. Alternatively it may be preferable to locate a turbine in the flow of mud through the mandrel 2, the turbine may be used to power hydraulics as shown in FIG. 2 or alternatively an electronic generating system which would then form an alternative means to power the stabiliser blades.

Figure 5:
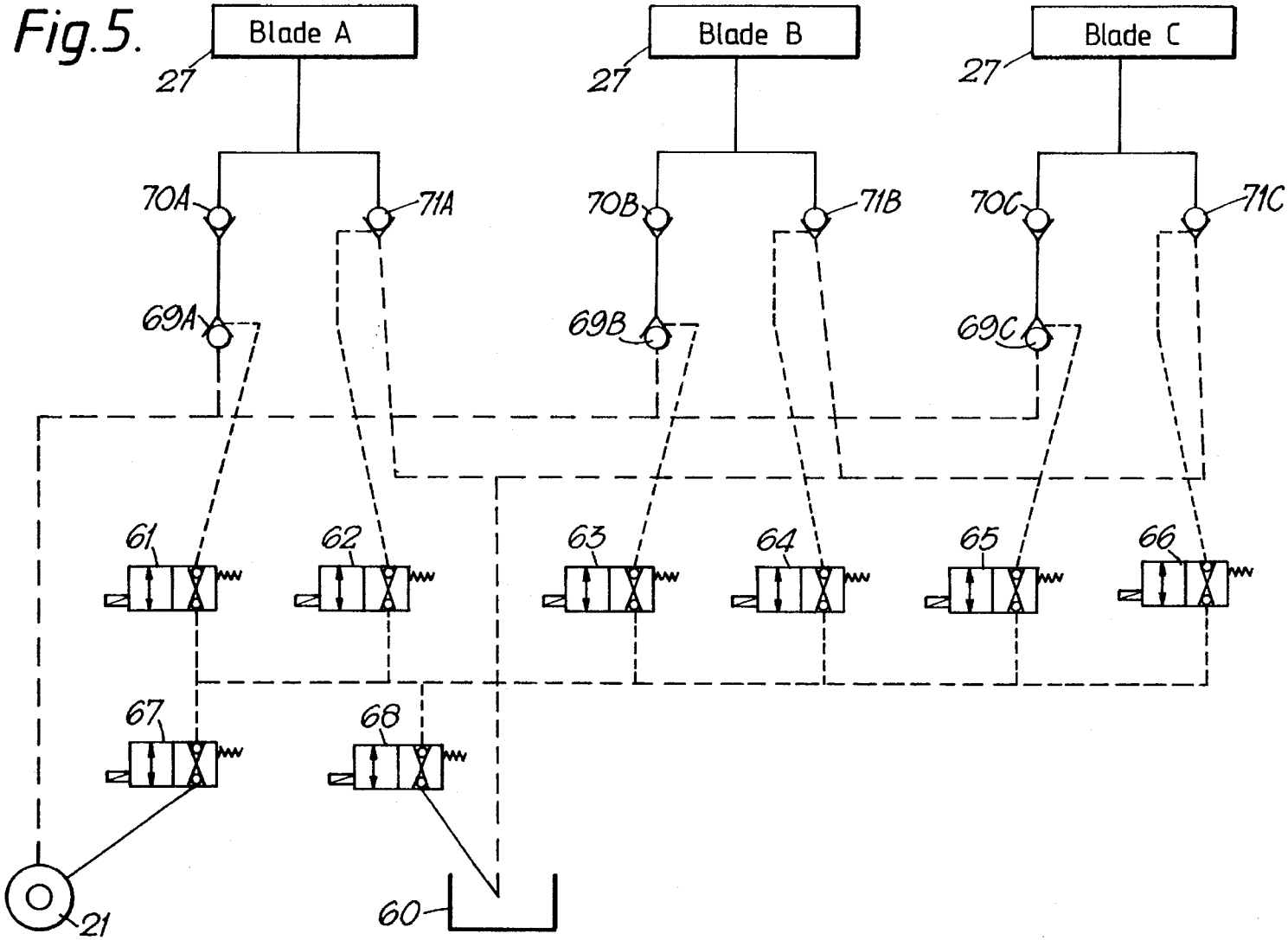
FIG. 5 shows details of a hydraulic circuit controlling the blades of the tool.

A valve body 23 and a control unit 24 are provided within the body 5. A number of blades 27 (of which only one is shown in FIG. 2) are disposed circumferentially around the inner sleeve 6 extending through the outer sleeve 7. In the preferred embodiment of the present invention three parallel blades 27 are disposed equi-angularly around the circumference of the stabiliser (see FIG. 3). The valve body 23 is controlled by hydrauiic switches which act on instruction from the control unit 24 to open and close hydraulic lines 35 which communicate with the blades 27. Details of the hydraulic circuit controlling the blades are shown in FIG. 5 and will be discussed hereinafter.

Means 26 are provided for extending and retracting the blades 27, which means may be piston assemblies as shown, wedges or any other suitable means. A potentiometer 25, or an ultrasonic measuring device, or other suitable measuring device is provided for each extending means 26, to calculate the displacement of each of the blades 27 from the retracted position, and to transmit this information to the control unit 24. Each of the blades 27 is independently extendible and retractable to retain the stabiliser in the desired orientation relative to the well bore centreline.

The low pressure piston 15 is a floating piston which travels upwards (i.e. to the right as shown in FIG. 2) towards the spring stop 17 as any of the blades 27 of the stabiliser are extended, and downwards (i.e. to the left as shown in FIG. 2) away from the spring Stop 17 as any of the blades are retracted.

Figure 3:
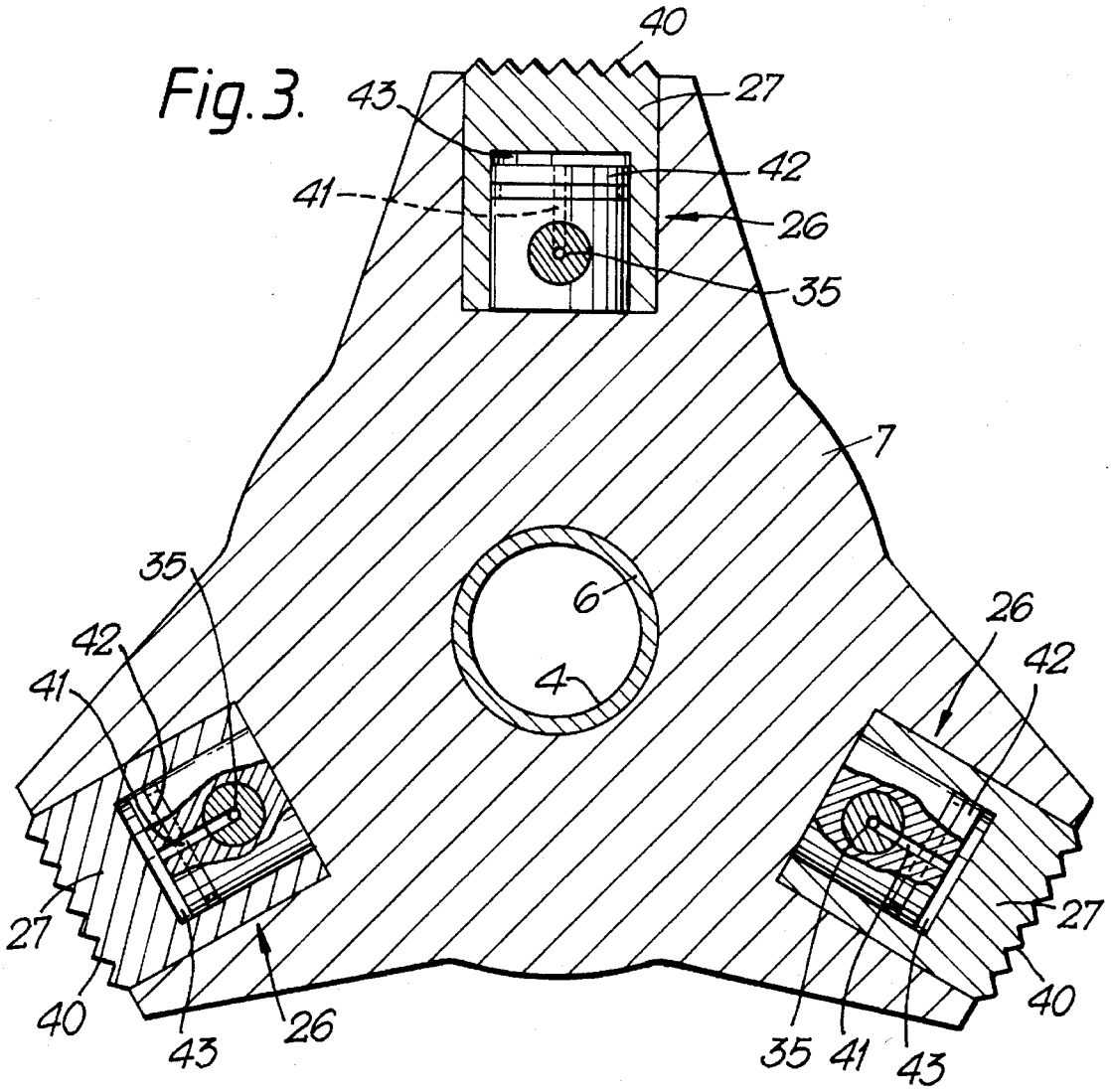
FIG. 3 is a cross-section taken on line III—III of FIG. 2.

The piston assemblies 26 and blades 27 of one embodiment of the present invention are shown more clearly in FIG. 3. The preferred arrangement of three parallel blades 27 is shown, and the blades may be provided with longitudinally serrated outer edges 40 which enable the stabiliser to grip the edges of the well bore more effectively.

Each hydraulic line 35 communicates with a stabiliser blade 27 via a port 41 through the piston 42 in each piston assembly 26. Thus, when hydraulic pressure changes are transmitted from the valve body 23 (see FIG. 2) along a hydraulic line 35, these pressure changes are passed through port 41 and into chamber 43 between a piston 42 and the blade 27. The piston 42 remains stationary, and the blade is extended or retracted in response to these pressure changes.

FIG. 5 shows a hydraulic circuit which may be used to control the blades 27. For clarity, the three blades 27 are labelled blades A, B and C, respectively. Each blade is controlled by three check valves 69, 70 and 71, the check valves being operated by solenoid-controlled pilot valves 61 to 68. The pump 21 provides the source of pressurised hydraulic fluid and a reservoir 60 is provided for dumping the pressurised fluid.

The sequence of operations for moving blade A will now be described in more detail by way of example, but a similar sequence will also be used to move blades B and C.

If it is required to extend blade A, solenoid-controlled pilot valves 61 and 67 are opened, pressurised fluid from pump 21 acts via valves 61 and 67 to open check valve 69A. Pressurized fluid then flows directly from pump 21 via check valves 69A and 70A to extend blade A. Once blade A has reached the required extension, pilot valve 61 is again activated and pilot valve 68 is also opened to allow the pressurised fluid holding check valve 69A open to flow into the reservoir 60 such that valve 69A closes and blade A is locked in the extended position. In order to retract blade A, pilot valves 67 and 62 are activated such that pressurised fluid from the pump 21 acts to open pilot-operated check valve 71A, and the fluid holding blade A in position can flow into the reservoir 60 allowing blade A to retract. Check valve 70A prevents back flow through pilot-operated check valve 69A. Blade A can then be locked in the required retracted position by activating pilot valves 68 and 62 to allow the pressurised fluid holding check valve 71A open to flow into the reservoir 60 such that valve 71A closes and blade A is again locked in position.

Pilot valves 63 and 64 combined with pilot valves 67 and 68 control check valves 69B and 71B to extend and retract blade B. Pilot valves 65 and 66 combined with pilot valves 67 and 68 control check valves 69C and 71C to extend and retract blade C.

The solenoid-controlled pilot valves may be activated in response to signals sent by the control unit 24. The control unit is supplied with information about the rotational speed of the pump, the temperature, blade position and inclination of the tool and may be programmed to use these inputs to control the pilot valves and hence the tool face and offset of the tool.

Figure 4:
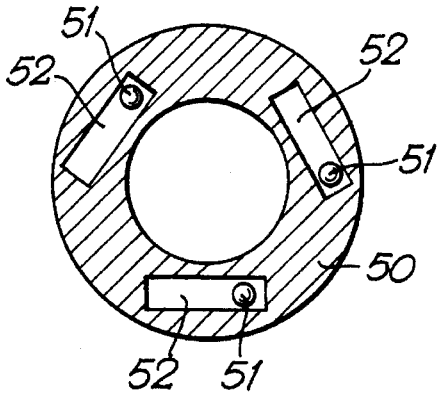
FIG. 4 shows detail of the valve body shown in FIG. 2.

As shown in FIG. 4 the stabiliser valve may be controlled by a sensor 50 which relies on the movement of three ball bearings 51. Each ball bearing is located in a slightly inclined slot or ball bearing track 52, and each ball bearing track is aligned with a stabiliser blade 27. The action of gravity on any one of the ball bearings 51 will cause it to roll to the lowest point inside the ball bearing track. If the ball bearing settles at one end of the track it will form a link in a hydraulic solenoid (not shown), and if it settles at the other end of the track it will not form such a link. The hydraulic solenoid is the device which powers the extension and retraction of the blades. This electronic, hydraulic or mechanical sensor is intended for use in the variable stabiliser of the present invention when such a stabiliser is used to control vertical drilling by the BHA.

When the stabiliser is used for this purpose with the sensor 50 described above, there should be appropriate timers in the system, e.g., electronic or hydraulic timers. The hydraulic timers are also solenoids. The first timer will allow the ball bearings to re-set themselves approximately one minute after the rotation of the drill string has ceased. This is achieved by spring loading a piston with a bleed hole. The piston is exposed to the pressure from the hydraulic pump. When the drill string rotation ceases the pump will stop allowing the spring loaded piston to bleed. As it bleeds it will deactivate the hydraulic solenoid and allow the ball bearings to settle in their new position before re-activating the hydraulic solenoid again.

The second hydraulic timer is used to de-activate the complete system in preparation for pulling out of the hole. It is also a spring loaded piston with a bleed hole, which blocks the high pressure line to the blades, and opens a line to the low pressure reservoir.

The control unit 24 therefore comprises an electric power source, a means for counting the number of revolutions of the mandrel 2 in a given time frame to assess whether the drillstring is rotating, and a means to trigger the hydraulic switches at the correct time, and an the correct order if so required.

When the variable stabiliser is used for vertical well drilling control, the variable stabiliser is preferably positioned as the first string stabiliser, approximately ten feet above the nearbit stabiliser and thirty feet below the far bit stabiliser.

If the well bore deviates from the vertical, the sensor will trigger the blade, or blades on the low side of the bore, to extend outward when a predetermined inclination has been reached. This action moves the centre line of the variable stabiliser above the centre line of the borehole. This will in turn force the assembly to drill back towards vertical. When the wellbore inclination has been reduced to the required inclination, the tool will revert to its standby setting, will all three of the blades equally extended and in contact with the wall of the bore.

The operation of the stabiliser for vertical well control is intended to be automatic. Then the only requirement is that the rig crew are aware of the timing sequence for resetting of the stabiliser blades. The sequence of operations may, for example, be as follows. Initially, the drill string is rotating and drilling ahead, and one, two or all three of the blades are extended. Drill pipe rotation is ceased, all the blades are extended and about a minute later the sensor is activated. Over the next ten seconds the new inclination of the drill string is sensed. The blades are activated to move to the new required position and the sensor becomes dormant. Drilling recommences. This sequence of operations will be repeated until the drill pipe remains substantially non-rotational for ten minutes, the blades are then fully retracted; this position is required when lifting the drill string out of the well bore, or if the BHA is stuck.

The only comparable tool to the vertical well control stabiliser is a steerable motor, use of which is normally unjustified on economic grounds. The stabiliser of the present invention is intended to run at a much lower cost.

In areas where the formations are known to dip, the use of the vertical well control stabiliser will allow the optimum drilling weight to be applied to the bit, rather than the rig time wasting high RPM/low weight on bit/reaming operations associated with pendulum assemblies. There will also be no requirement to make costly correction runs since the stabiliser repeatedly corrects the drilling direction before the deviation becomes too large.

The loss of oil base muds to the drilling industry will bring formation swelling difficulties. The variable stabilisers will work equally well in these undergauge holes and will for extreme situations allow a full string of variable stabilisers to be run with the near bit stabiliser set to hold the drill string in the centre of the hole. This will now provide a well stabilised BHA with the bit being the only item likely to grip the wellbore.

When the variable stabiliser is used for the stabilisation of casing milling and fishing tools, it is preferably placed directly below the casing milling device. Its purpose is to centralise the milling assembly and restrict lateral movement. This will greatly improve the life and performance of the milling tool cutting structure.

The casing milling stabiliser is similar in all aspects to the stabiliser described above for use in vertical well control. The blades of the stabiliser are fully retracted when running in and out of the bore. However, when drill string rotation is sensed all three blades extend and grip the casing. This will centralise the assembly for the duration of the operation.

If more than one casing string is to be milled and the casings are not centralised, the vertical well control stabiliser will provide centralisation of the BHA to the uppermost part of the casing. This allows the milling blades to cut up to the next casing size.

The tool of the present invention is also intended for use as a controlled orientation stabiliser in directional drilling assemblies. The variable stabiliser would normally be positioned approximately 3 m above the near bit stabiliser and can be directed to provide either of the following modes of operation:

1. A tool that will affect the inclination drilled by the assembly. The stabiliser can, on demand, be set to hold the drill string anywhere between approximately 13 mm below and 13 mm above the centre line of the borehole. The degree of build or drop this will create, obviously depends on the positioning of the stabiliser within the drill string. Maximum bends or dog legs of about 2 degrees in 30 m can be drilled in this configuration; or 2. A tool that will provide all the advantages of a steerable motor where the stabiliser can, when required, be requested to provide any toolface setting at a controlled blade offset. This will provide the exact dog leg required at the desired toolface direction.

An important advantage of the present invention is that there will be no requirement to push a non-rotating drill string down the hole. This normally creates anything up to a 50% reduction in rate of penetration (ROP) when orienting a steerable motor and is not a phenomenon that would be experienced with the variable stabiliser system. Furthermore, the toolface setting is maintained by the tool itself and does not, as in the case of the steerable motor, require constant monitoring by the directional driller. This offers an unprecedented level of control over the wellbore trajectory and a major opportunity to refine the art of directionally drilling wells.

The variable stabiliser allows a constant dog leg to be drilled from the start to the end of each well hole section. It is a simple matter to calculate the required blade offset to produce a particular dog leg. This offset along with the toolface setting is transmitted to the stabiliser. Should the estimation of bit walk prove to be incorrect, it is a straightforward task to reprogramme the stabiliser with no loss of rig time. The constant dog leg drilled will result in a number of further advantages: (a) reduced torque and drag, which is especially important with the oil base mud changes that are being introduced; (b) greater measured depths can be considered when reduced torque and drag can be guaranteed; (c) casing wear will be reduced; and (d) key seat problems will not appear.

With the tool of the present invention, it is also possible to provide a combination of the various types of the variable stabilisers described earlier in order to perform sidetracking operations, where controlled bit sideloadings and bit face tilt angles can be created, by programming the degree of side-cutting force into a variable nearbit stabiliser. This would be complimented by a variable string stabiliser offset in the opposite direction to the variable nearbit stabiliser, thus providing the degree of bit face offset to effect the side track.

The variable stabilisers can then be adjusted to provide normal directional control, after the side track has been completed, therefore removing the requirement for unwanted additional trips to change the BHA configuration.

The major advantage to this system is that it will force the assembly to drill into a formation that is harder than the cement plug that has just been set, thus avoiding the problem of being unable to effect a side track in hard formations.

In controlled orientation and side tracking tools, the downhole processor provided by the control unit 24 should preferably incorporate an electrical power source, two or more accelerometers for the purposes of sensing the earth's gravity, a means to count the number of revolutions of the mandrel in a given time frame, and to then assess whether a coded message has been sent, and a means to trigger the hydraulic switches at the correct time and in the correct order. Upon receipt of a coded message, the control unit must store it in its memory. When required to do so, the control unit should read the memory and read the blade extensions, from this calculate the diameter of the borehole, and after reading the outputs from the accelerometers calculate the required blade extensions to achieve the desired objective. The blades may then be adjusted in the following way, starting with the uppermost blades first.

1. Open the hydraulic line from the low pressure chamber to any blade or blades that may need retracting and monitor the blades until the desired position is reached, when they should be shut off from communication with both low and high pressure reservoirs.

2. At some short time interval later open up the high pressure chamber to any blade that may need extending and shut off when so done.

3. If required, open up the third blade to the high pressure reservoir until the desired objective is achieved.

4. Open the uppermost blade to the high pressure chamber, re-read all three blade extensions and repeat steps 1 to 3 if out of limits. The preferred method of determining how far each blade has extended is to use an ultrasonic measuring device.

Preferably, two of the blades will be signalled to move to the exact offset required, and the third blade is left open to the hydraulic power from the high pressure reservoir, so providing the power to the third blade to maintain its orientation and to grip the well bore so that the stabiliser does not rotate.

One arrangement for controlling the variable stabiliser for use in controlled orientation and side tracking operations will now be described in more detail, by way of example.

The control unit has at its heart two accelerometers, aligned to the X and Y axis. Their purpose is to sense the earth's gravity and track the orientation of the blades of the tool. There is also a pressure sensor which is located on the hydraulic output line from the pump. It is used to assess the rotational speed of the drill string. Alternatively, a hall sensor may be used to sense rotation at the pump. Finally to measure the offset of each blade there is an ultrasonic distance measuring crystal located in the crown of the slave piston driving that blade.

When drill string rotation is initially sensed it will trigger an internal clock, this will combine its output with that of the pressure sensor from the pump to count the number of revolutions of the drill string in a given time frame, so forming the system for reading the coding for the tool settings required.

If the blades are not currently extended they will be triggered to do so after 15 seconds. The stabiliser will now accept new information from surface between one and five minutes. If no information is to be sent the system will immediately progress to the next step.

The stabiliser blade extensions are now read. This will define the current hole diameter which will in turn establish the centreline of the borehole. The measurement of borehole diameter prior to commencement of a curve drilling operation accurately establishes a starting point for the offset programming. The stabiliser blades will now be set according to the information stored in the control unit memory which, combined with the output from the accelerometers, will provide the exact blade extensions required. If the code has yet to be sent the stabiliser will retain its zero offset with all three blades equally extended.

As the run continues the stabiliser will reset itself to the required blade offset and toolface at each connection (identified by the lack of string rotation for one minute), this will compensate for any blade slippage that may have occurred while drilling the last joint/stand of drillpipe. The two lowest blades on the stabiliser will be locked out to the required extension with the third uppermost blade providing the force necessary to maintain the orientation of the stabiliser assembly while drilling ahead.

There are two time frames when the stabiliser is receptive to receiving a new set of coded signals. The first is at the start of drilling a connection. The second is ten minutes after the start of drillings, this will allow time for the measure while drilling (MWD) results to be received and analysed. On receipt of new information the stabiliser will reset itself immediately while drilling ahead and maintaining this setting until instructed to do otherwise.

All three blades will retract after ten minutes of no drill string rotation to prepare the tool for pulling out Of the well bore.

The method of communication from the surface to the stabiliser is by counting the number of drill string revolutions in a given time frame. Normal rotary table speeds are in the range of 100 to 250 RPM. The system is triggered to accept a new set of instructions in the following way.

The time frame between one minute, and one minute twenty seconds after the commencement of the drill string turning shows that the average RPM is between 40 and 80, if it is out with this range no action is taken. However, if it is within this range, the number of revolutions of the drill string between minute two and two and a half minutes will describe the amount of blade offset required, coded in the following way.

50–60 RPM=2.5 mm offset

60–70 RPM=5.1 mm

70–80 RPM=7.6 mm

80–90 RPM=10.2 mm

90–100 RPM=12.7 mm

The number of revolutions between minute three and minute five will set the toolface azimuth that is required coded in the following way.

40 revolutions=0°

60 revolutions=60°

80 revolutions=120°

100 revolutions=180° and so on.

The exact number of revolutions will be counted by the tool to provide a more exact toolface setting e.g. 63 revolutions=69°.

The way in which the tool counts the RPM is to count the pulses of flow from the downhole pump.

A number of further advantages are provided by use of the stabiliser of the present invention. The setting of the blades and of the drill string is constantly monitored and maintained by the accelerometer package. It is possible to reset either the blade offset or the tool azimuth at any time while drilling ahead with no loss of rig time. Thus the average five to ten minutes spent orienting a steerable motor at each joint/stand will be time saved by this system. The time saved will contribute to the running costs of the variable stabiliser system. Mud motors require substantial amount of hydraulic pressure to operate, with 700 PSI not uncommon. The pressure allowed for the steerable motor will now be available for improved hole cleaning/bit cutter cooling, offering improvements in ROP and bit life.

The tool of the present invention can also be used to measure the diameter of the well bore in the following way. Two of the blades are locked in position and the output of the sensors to the third blade is monitored by recording equipment to provide a record of the diameter of the bore. This measurement can be taken as the tool is run into the bore. More preferably, the tool can be included in the drill string when the bore is being drilled and the measurement of diameter can be taken as the tool is withdrawn from the bore after the bore has been cut, thus obviating the need for a separate diameter logging run, and the need for a separate tool to perform such a run.

There are a number of areas in the North Sea where the ROP loss with an oriented steerable motor is so great that it has great difficulty in sliding along the hole. With the loss of oil base mud this will be an increasing problem for some operators. The controlled orientation stabiliser of the present invention will not suffer from this problem. Furthermore, the system is considerably easier to operate than a steerable motor as it maintains its own toolface setting. This ease of operation will obviously contribute to improved management by the directional driller over the trajectory of the wellbore. BHA design will also be simplified, as the principles of design can be based around standard rotary assemblies.

In areas of known formation dips, operators occasionally use measure while drilling (MWD) to track the inclination in vertical wells. This will no longer be necessary as the wells will automatically maintain verticality.

Operators sometimes find they spend a considerable amount of time reaming to bottom with their second and subsequent bit runs. With the present invention it will be possible to run a hole opener or roller reamer above, or as, the top stabiliser in a controlled orientation assembly. This will ensure a full gauge hole for subsequent bit runs, so minimising any reaming back to bottom operations.

Finally the body or the blades of the tool of the present invention can carry or house logging sensors which determine the characteristics of the formation which is being drilled. Such sensors may be density or neutron logging tools, for example.

In any of the above described uses of the tool of the present invention, the tool may incorporate within the control unit recording means for predetermined operating sequences and/or for storing logged data.

Although the invention has been particularly described with respect to a stabiliser and a directional drilling control tool, clearly the invention has many other applications in the field of downhole tools.

The invention may also be embodied as a tool which is adapted to sense and/or control vibrations in the drill string. To this end, means may be provided to lock two of the blades at a pre-determined extension and to move the third blade outwardly to bring all three blades into engagement with the well bore. By monitoring movement of the third blade by suitable means, vibrations within the drill string may be monitored. By increasing or reducing the force applied to the third blade it may be possible to control or reduce such vibrations. This technique may be of particular value during milling operations or during the development of milling tools.

A typical application of the use of the stabiliser of the present invention will be to cause a well bore to drill back to vertical. The operation of the stabiliser is designed first to overcome formation or other tendencies, causing the drilling assembly to drill back to vertical and secondly to maintain verticality for the remainder of the section to be drilled.

Vital to the successful operation of any deviation control device is that any unwanted kinks or dog legs in the well bore are minimised. Current technology uses mud motors to control the trajectory of well bores, their fixed bend generally creates a fixed dog leg. Similarly the variable stabiliser, if set to provide a given offset when the well bore strayed from vertical, would provide a fixed dog leg which could possibly over correct the inclination error found, to the point that the well bore may end up being drill beyond vertical and back up 180° from the original error.

What is needed is a device that will, on first entering a well bore, store in memory the inclination and direction of any errors present. From a set of tables stored in the memory an initial offset commensurate to the size of the error will be set at the required direction. When drilling stops to add the next joint of drill pipe, the stabiliser will store in memory the new inclination and direction. A comparison will now be made between the first and the second readings to establish the drilling trend and the required setting that will drill the well back to vertical in the required number of drilling stops. When the well bore is back to vertical only the formation tendencies will require correcting. The automatic sequence of comparing readings to those taken at the previous drilling break will ensure that the stabiliser will continue to maintain well bore verticality automatically as formation tendencies change.

I claim:

1. A downhole tool adapted to be connected to a drill string by a connection atop the tool, the tool comprising: a mandrel for connection with the drill string; a body, the mandrel being rotatable within the body; a plurality of blades individually extendible radially from the body to engage the wall of a well bore, the radial position of the blades being adjustable between a first retracted position and a second extended position, to position a centreline of the mandrel at a desired position relative to a longitudinal axis of the well bore; a positioning system for holding each of the blades at the retracted position, at the extended position or at any intermediate position between the retracted and extended positions; a control unit for controlling the positioning system, the control unit being operable to maintain the blades in engagement with the wall of the well bore and the centreline of the mandrel at a desired position relative to the centreline of the well bore as the drill string advances during a drilling operation regardless of variations in the well bore diameter; and an energizing source; wherein at least two of the blades are locked at a given extension, with the remaining blades communicably connected to the energizing source, thus allowing those energized blades to remain in contact with the well bore when compensating for variations in the nominal diameter of the well bore.

2. A tool according to claim 1, wherein said control unit is programmable when the tool is down the well bore, by means of coded signals sent from the surface.

3. A tool according to claim 1, wherein said control unit incorporates a device for counting the revolutions of the drill string, the device being selected from the group consisting of a device for counting magnetic pulses from a marker on the mandrel, a device for counting magnetic pulses from a marker on a device driven by the mandrel, an infra-red sensor sensing a marker on the mandrel, an infra-red sensor sensing a marker on a device driven by the mandrel, an ultrasonic device sensing a marker on the mandrel, an ultrasonic device sensing a marker on a device driven by the mandrel, a pressure sensor sensing changes of pressure caused by the action of the mandrel, a pressor sensor sensing changes of pressure caused by a device driven by the mandrel as it rotates within said tool, a device for electronically sensing the rotations of the mandrel, and a device for electronically sensing the rotations of a device driven by the mandrel as it rotates within said tool.

4. A tool according to claim 3, wherein said timer and said device for counting the revolutions from a means to read an encoded message sent to said tool via timed rotations of the drill string.

5. A tool according to claim 3, wherein said counting device is used to sense non-rotation of said tool mandrel.

6. A tool according to claim 1, wherein said control unit incorporates a device to receive, store and manipulate data.

7. A tool according to claim 1, wherein said control unit is electronic.

8. A tool according to claim 1, wherein the blades are extendible actuating means selected from the group consisting of hydraulic, mechanical and electric means.

9. A tool according to claim 8, wherein said actuating means are operably connected with a low pressure chamber and a high pressure chamber within the body via valve means, wherein a biased piston separates said low pressure chamber from said high pressure chamber, and wherein a floating piston separates said low pressure chamber from drilling fluid in the well bore.

10. A tool according to claim 9, wherein the control unit is operable to control said valve means to operate said actuating means.

11. A tool according to claim 10, wherein said control unit incorporates a sensor for detecting the extension of the individual blades, the sensor being an electronic, mechanical, magnetic, infra-red or similar, or ultrasonic device, or a combination of these.

12. A tool according to claim 1, wherein the blades of said tool can be controllably retracted.

13. A tool according to claim 1, wherein the desired position of the centreline of the mandrel can be at any point with a circle of predetermined diameter centered on the axis of the well bore.

14. A tool according to claim 1, wherein the power to drive said tool is derived from the rotation of the drill string driving said mandrel.

15. A tool according to claim 1, wherein the position of the blades is controlled to effect deviation of a borehole being bored by a drill string in which the tool is incorporated, the deviation being controlled by the tool such that the resultant borehole has a predetermined shape.

16. A tool according to claim 1, further comprising at least one logging sensor carried by the body or one of the blades of the tool.

17. A downhole tool adapted to be connected to a drill string by a connection atop the tool, the tool comprising: a mandrel for connection with the drill string; a body, the mandrel being rotatable within the body; a plurality of blades individually extendible radially from the body to engage the wall of a well bore, the radial position of the blades being adjustable between a first retracted position and a second extended position, to position a centreline of the mandrel at a desired position relative to a longitudinal axis of the well bore; a positioning system for holding each of the blades at the retracted position, at the extended position or at any intermediate position between the retracted and extended positions; and a control unit for controlling the positioning system, the control unit being programmable when the tool is down a well bore by means of coded signals sent from the surface and operable to maintain the blades in engagement with the wall of the well bore and the centreline of the mandrel at a desired position relative to the centreline of the well bore as the drill string advances during a drilling operation regardless of variations in the well bore diameter, said control unit incorporates a gravity sensor to establish orientation of the body of the tool.

18. A downhole tool adapted to be connected to a drill string by a connection atop the tool, the tool comprising: a mandrel for connection with the drill string; a body, the mandrel being rotatable within the body; a plurality of blades individually extendible radially from the body to engage the wall of a well bore, the radial position of the blades being adjustable between a first retracted position and a second extended position, to position a centreline of the mandrel at a desired position relative to a longitudinal axis of the well bore; a positioning system for holding each of the blades at the retracted position, at the extended position or at any intermediate position between the retracted and extended positions; and a control unit for controlling the positioning system, the control unit being operable to maintain the blades in engagement with the wall of the well bore and the centreline of the mandrel at a desired position relative to the centreline of the well bore as the drill string advances during a drilling operation regardless of variations in the well bore diameter, said control unit including a timer.

19. A downhole tool adapted to be connected to a drill string by a connection atop the tool, the tool comprising: a mandrel for connection with the drill string; a body, the mandrel being rotatable within the body; a plurality of blades individually extendible radially from the body to engage the wall of a well bore, the radial position of the blades being adjustable between a first retracted position and a second extended position, to position a centreline of the mandrel at a desired position relative to a longitudinal axis of the well bore; a positioning system for holding each of the blades at the retracted position, at the extended position or at any intermediate position between the retracted and extended positions; and a control unit for controlling the positioning system, the control unit being operable to maintain the blades in engagement with the wall of the well bore and the centreline of the mandrel at a desired position relative to the centreline of the well bore as the drill string advances during a drilling operation regardless of variations in the well bore diameter; wherein blade extensions are used to log the volume of the bore as the tool travels in and out of the borehole.

20. A tool according to claim 19, wherein said sensor comprises an annular disc coaxial with the mandrel, a number of horizontal or slightly inclined slots being formed in the disc and a movable member being positioned to move between a first and a second position in each slot, each movable member being adapted to form a link in a hydraulic, mechanical or electrical solenoid in one of its said first and second positions, said hydraulic solenoid being operable to control said valve means.

21. A downhole tool adapted to be connected to a drill string by a connection atop the tool, the tool comprising: a mandrel for connection with the drill string; a body, the mandrel being rotatable within the body; a plurality of blades individually extendible radially from the body to engage the wall of a well bore, the radial position of the blades being adjustable between a first retracted position and a second extended position, to position a centreline of the mandrel at a desired position relative to a longitudinal axis of the well bore; a positioning system for holding each of the blades at the retracted position, at the extended position or at any intermediate position between the retracted and extended positions; a control unit for controlling the positioning system, the control unit being operable to maintain the blades in engagement with the wall of the well bore and the centreline of the mandrel at a desired position relative to the centreline of the well bore as the drill string advances during a drilling operation regardless of variations in the well bore diameter; and an energizing source; wherein the blades on a gravitational low side of the hole are locked at a given extension, with the uppermost blade or blades communicably connected to the energizing source, thus allowing those energized blades to remain in contact with the well bore when compensating for variations in the nominal diameter of the well bore.

* * * * *